United States Patent [19]

Houston

[11] Patent Number: 4,954,402

[45] Date of Patent: Sep. 4, 1990

[54] EROSION RETARDER FOR REFRACTORY CORNERS

[76] Inventor: James L. Houston, 4329 S. Lakewood, Tulsa, Okla. 74135

[21] Appl. No.: 399,597

[22] Filed: Aug. 28, 1989

[51] Int. Cl.[5] ..... E04C 5/01

[52] U.S. Cl. ..... 428/597; 428/603; 52/257

[58] Field of Search ..... 428/597, 603, 595, 599; 52/254, 255, 256, 257

[56] References Cited

U.S. PATENT DOCUMENTS

| | | | |
|---|---|---|---|
| 149,413 | 4/1874 | Pagels | 53/257 |
| 881,463 | 3/1908 | Cushwa | 52/257 |
| 956,439 | 4/1910 | Shear | 52/256 |
| 1,035,278 | 8/1912 | von Rehder | 52/256 |
| 1,151,554 | 8/1915 | Allyn | 52/257 |
| 1,298,357 | 3/1919 | Krodinger | 52/257 |
| 1,454,042 | 5/1923 | Curtis | 52/255 |
| 1,652,674 | 12/1927 | Keas | 52/257 |
| 2,843,888 | 7/1958 | Hovey et al. | 52/257 |

*Primary Examiner*—John J. Zimmerman
*Attorney, Agent, or Firm*—Head & Johnson

[57] ABSTRACT

A retarder prevents the erosion of refractory material at a refractory corner over which fluid flows. The retarder is formed from an integral, flat piece of metal bent to form an elongated, horizontal leg and an elongated upright leg faced in parallel planes and connected by an elongated, rectangular baffle. The horizontal leg has a forward edge which tapers upwardly and forwardly to an acute angle. The upright leg has an upper edge which tapers upwardly and forwardly to an angle which complements the acute angle on the forward edge of the horizontal leg. The two legs are integrally connected by an elongated rectangular baffle with one end extending from the tapered edge of the horizontal leg and the other end extending from the tapered edge of the upright leg. The baffle is perpendicular to the legs. Each of the legs has at least two ears, one extending integrally away from each side of its leg. The ears will be embedded in the refractory material proximate the leg to secure the bond between the refractory material and the legs. The baffle will be embedded in the refractory material disposed along the corner of the refractory to anchor the refractory material along the refractory corner against erosion as fluid flows over the corner.

In one embodiment, the horizontal and upright legs are downwardly or rearwardly turned, respectively, in complementary circular arcs with the rectangular baffle connecting the edges of the legs at the ends of the arcs.

Preferably, the complementary tapers or arcs are approximately at an angle of forty-five degrees.

10 Claims, 2 Drawing Sheets

EROSION RETARDER FOR REFRACTORY CORNERS

BACKGROUND OF THE INVENTION

This invention relates generally to the construction of refractories for use in the refining industry and more particularly concerns the anchoring of refractory material at the corners or exposed edges of a refractory.

Refractories are generally constructed on a metal base which supports a metal grid system welded to the base to form a honeycomb. This honeycomb retains the refractory material which is poured, packed or pressed into it in a soft or pliable state. The corners or exposed edges of the refractory are commonly reinforced by a number of flat metal brackets formed to a ninety degree angle and welded in parallel vertical planes along the corners or edges of the refractory. Small ears punched toward the opposite sides of the bracket provide some gripping engagement of the brackets with the refractory material pressed between them.

Such corner reinforcements are inadequate in that, as refined material flows over the refractory corner, it erodes the refractory material between the brackets where there is no support. The problem is exacerbated in the refining of some abrasive mixtures, such as oil containing gritty catalysts which may flow over the refractory corner at temperatures in the range of 1500° F. Highly abrasive mixtures will cause the corners of a refractory to deteriorate quite quickly, particularly at higher temperatures.

Present solutions to the problem include the provision of holes through the corner of the flat corner brackets so that rods can be extended through the brackets to provide additional support at the point of erosion. Alternatively, metal slats are welded at a forty-five degree angle between the brackets for the same purpose. Such modifications obviously result in tedious, lengthy and costly procedures in making a refractory.

It is, therefore, an object of this invention to provide an erosion retarder for refractories that anchors the refractory material at the corners and exposed edges of the refractory. Another object of this invention is to provide this anchorage for the refractory materials without adding to the complexity of constructing the refractory. Similarly, it is an object of this invention to provide a simple, unitary device which accomplishes all of the above objectives.

SUMMARY OF THE INVENTION

In accordance with the invention a retarder for preventing the erosion of refractory material at a refractory corner over which fluid flows is formed from an integral, flat piece of metal. The retarder has an elongated, horizontal leg and an elongated upright leg. The legs are faced in parallel planes. The horizontal leg has a forward edge which tapers upwardly and forwardly to an acute angle. The upright leg has an upper edge which tapers upwardly and forwardly to an angle which complements the acute angle on the forward edge of the horizontal leg. The two legs are integrally connected by an elongated rectangular baffle with one end extending from the tapered edge of the horizontal leg and the other end extending from the tapered edge of the upright leg. The baffle is perpendicular to the legs. Each of the legs has at least two ears, one extending integrally away from each side of its leg. The ears will be embedded in the refractory material proximate the leg to secure the bond between the refractory material and the legs. The baffle will be embedded in the refractory material disposed along the corner of the refractory to anchor the refractory material along the refractory corner against erosion.

In an alternate embodiment, the horizontal and upright legs may be downwardly or rearwardly turned respectively in complementary circular arcs with the rectangular baffle connecting the edges of the legs at the ends of the arcs.

Preferably, the complementary tapers or arcs would be approximately at an angle of forty-five degrees.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figures 1, 2, 4:
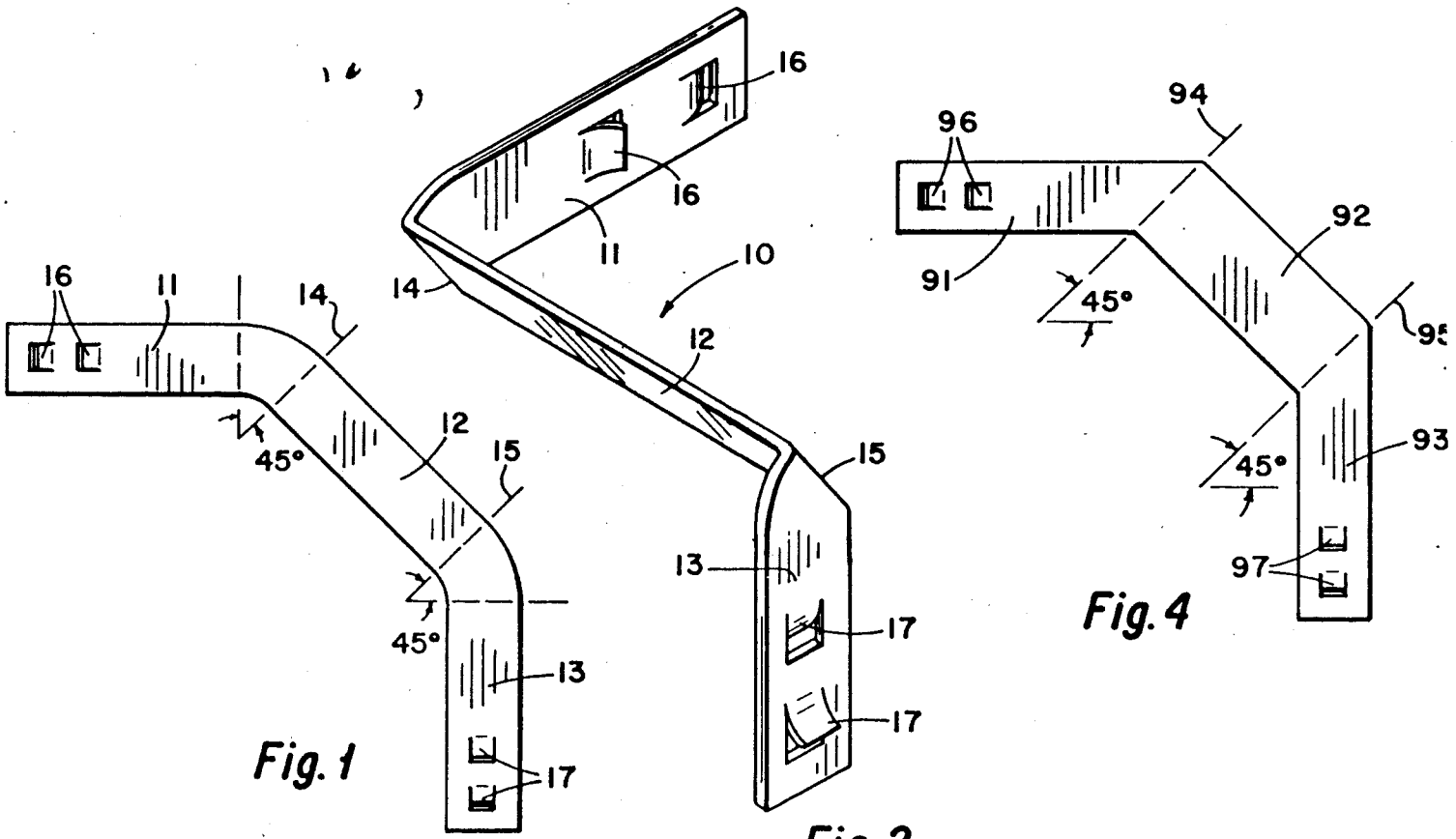
FIG. 1 is a plan view of a blank in a preferred embodiment of an erosion retarder.
FIG. 2 is a perspective view of a retarder formed from the blank illustrated in FIG. 1.
FIG. 4 is a plan view of another embodiment of the erosion retarder.

Turning first to FIG. 1, a plan view of the blank of a preferred embodiment of an erosion retarder for refractory corners is illustrated. As shown, the retarder consists of a flat integral metal member 10 having a horizontal leg 11 which turns down in a circular arc forty-five degrees to a baffle 12 which turns down in a circular arc another forty-five degrees to a vertical leg 13. While the baffle 12 preferably lies at forty-five degrees with respect to the horizontal and vertical segments 11 and 13, variations on this angular arrangement are possible and perhaps even more beneficial in particular structural situations. In the embodiment shown, the forty-five degree radii 14 and 15 defining the legs and baffle are also the bend lines of the member 10 as will hereinafter be discussed. The horizontal leg 11 has two or more ears 16 punched through it which will be bent toward opposite sides of the leg 11 and similarly the upright leg 13 has two or more ears 17 punched through it which will be bent toward opposite sides of the leg 13.

Turning to FIG. 2, the blank shown in FIG. 1 is illustrated in its completed form. In the finished piece, the horizontal leg 11 and the baffle 12 have been bent along their connecting forty-five degree radius 14 to form a right angle between the horizontal leg 11 and the baffle 12. Similarly, the baffle 12 and the upright leg 13 have been bent along their connecting forty-five degree radius 15 in a direction opposite to the bend at the other radius 14 to form a right angle between the baffle 12 and the upright leg 13. Thus, the baffle 12 functions as a horizontal spacer between the horizontal leg 11 and the vertical leg 13.

Figure 3:
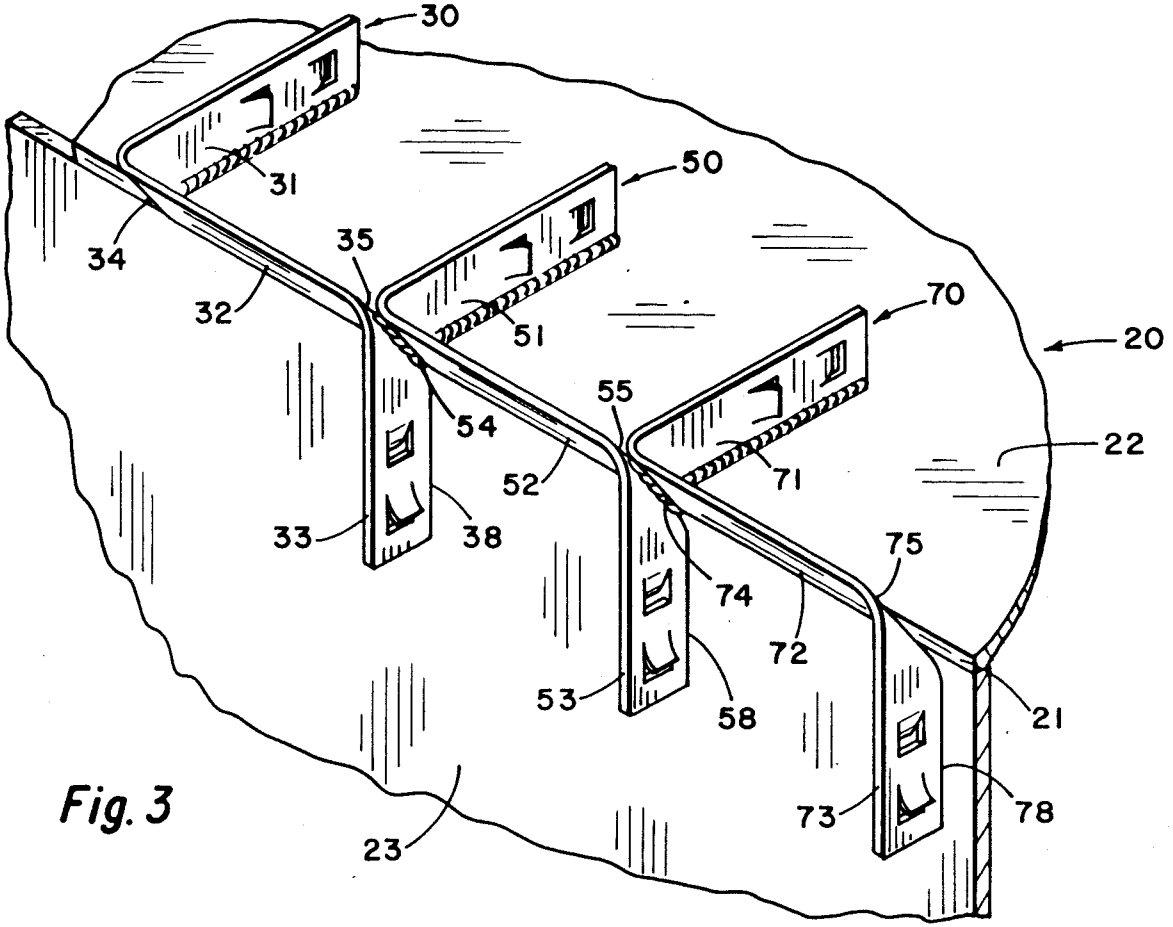
FIG. 3 is a perspective view illustrating the use of a multiplicity of the retarders to form a refractory corner.

The use of the retarders in the formation of the corners or exposed edges of the refractory is illustrated in FIG. 3. A refractory base 20 is shown in part, including the corner of the base 20 that will be disposed along the refractory corner. Several retarders 30, 50 and 70 have the bottom edge of their horizontal legs 31, 51 and 71 welded to the horizontal portion 22 of the base member 20. The horizontal legs 31, 51 and 71 are parallel to each other and the baffles 32, 52 and 72 are aligned. The left side bends 54 and 74 of two of the retarders are in abutment with the right side bends 35 and 55 of their adjacent retarders. Thus, the baffles 32, 52 and 72 form a continuous forty-five degree surface along the refractory corner to anchor the refractory material in place. The inside edges 38, 58 and 78 of the upright legs are welded to the vertical portion 23 of the base member 20. In a preferred embodiment these retarders would be welded together at their angular abutments and the ends of the horizontal and upright legs would be welded to adjacent their honeycomb surfaces on the base (not shown).

Once the refractory, including the corners, has been assembled, the refractory material is poured, packed or pressed into the honeycomb and the prepared corners. It is then screeded to its appropriate contour. When the refractory material is set, finish work can be done on the refractory. The ears 16 and 17 on the horizontal and upright legs are embedded with the legs in the refractory material to anchor the material to the legs. The baffle segment 12 is embedded in the refractory material along the corner of the refractory to prevent erosion of this refractory material as fluid flows over the corner.

Another embodiment of the erosion retarder is illustrated in FIG. 4. In this embodiment, the horizontal leg 91 connects the baffle 92 at a forty-five degree angle at bend line 94 and the baffle 92 meets the upright leg 93 at a forty-five degree angle at bend line 95. Ears 96 and 97 are provided in the legs 91 and 93 as before. As was pointed out in reference to the circular configuration illustrated in FIGS. 1 and 2, the angular relationship of the bend lines 94 and 95 need not be at forty-five degrees as long as the relationship of the angles is complementary.

Thus, it is apparent that there has been provided, in accordance with the invention, an erosion retarder that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A bracket for use in anchoring refractory material along a corner of a refractory over which fluid flows, comprising:

horizontal means for embedding in the refractory material disposed on the horizontal portion of the refractory corner;

upright means for embedding in the refractory material disposed on the vertical portion of the refractory corner; and baffle means integrally connecting said horizontal means and said upright means for embedding in the refractory material disposed on the corner portion of the refractory corner.

2. A bracket for use in anchoring refractory material along a corner of a refractory over which fluid flows, comprising:

an elongated, flat, horizontal leg having a forward edge upwardly and forwardly tapered to an acute angle; and an elongated, flat, upright leg having an upper edge upwardly and forwardly tapered to an angle complementary to said acute angle;

said horizontal leg and said upright leg being faced in parallel planes and each having ears integrally extending away from both sides thereof for embedding in the refractory material disposed proximate said legs; and an elongated, flat, rectangular baffle integrally and perpendicularly connected at one end to said tapered edge of said horizontal leg and at the other end to said tapered edge of said upright leg for anchoring refractory material disposed along said baffle between said legs.

3. A bracket according to claim 2, said acute and complementary angles being approximately 45 degrees.

4. A bracket for use in anchoring refractory material along a corner of a refractory over which fluid flows, comprising:

an elongated, flat, horizontal leg; and an elongated, flat, upright leg;

said legs being faced in parallel planes, said horizontal leg having its forward end downwardly turned in a circular arc less than 90 degrees and said upright leg having its upper end rearwardly turned in a circular arc complimentary to the first arc; and an elongated, flat, rectangular baffle integrally and perpendicularly connected at one end to said downwardly turned end of said horizontal leg and at the other end to said rearwardly turned end of upright leg;

said legs each having ears integrally extending away from both sides thereof for embedding in the refractory material disposed proximate said legs and said baffle for embedding in the refractory material disposed along said baffle between said legs.

5. A bracket according to claim 4, said arc and said complimentary arc each being approximately 45 degrees.

6. A bracket according to claims 2 and 4, each of said ears comprising a tab punched in its respective one of said legs.

7. A bracket according to claims 4 and 5, the inside radii of said downwardly turned end of said horizontal leg and of said rearwardly turned end of said upright leg being negligible.

8. A bracket according to claims 4 and 5, the inside radii of said downwardly turned end of said horizontal leg and of said rearwardly turned end of said upright leg being in the range of ⅛ to ½ inches.

9. A bracket according to claims 2 and 4, said legs and said baffle being approximately ¾ inches wide and 3/16 inches thick.

10. A bracket according to claims 2, 4 and 9, said legs being 1½ to 3 inches long and said baffle being 1 to 2 inches long.

* * * * *